United States Patent [19]

Barnes, Jr. et al.

[11] 3,976,890

[45] Aug. 24, 1976

[54] RADIATION DAMAGE RESISTANT MIRROR

[75] Inventors: William P. Barnes, Jr.; G. Richard Wirtenson, both of Acton, Mass.

[73] Assignee: Itek Corporation, Lexington, Mass.

[22] Filed: Sept. 9, 1974

[21] Appl. No.: 504,603

[52] U.S. Cl. ..... 250/510; 250/505

[51] Int. Cl.[2] ..... G21K 3/00

[58] Field of Search ..... 250/505, 508, 510; 350/1, 288, 290, 319

[56] References Cited

UNITED STATES PATENTS

| | | | |
|---|---|---|---|
| 1,542,318 | 6/1925 | Pollock | 350/290 |
| 2,179,491 | 11/1939 | Cain | 350/290 |
| 2,901,631 | 8/1959 | Hansen et al. | 250/510 |
| 3,504,963 | 4/1970 | Davies et al. | 350/290 |
| 3,645,600 | 2/1972 | Doctoroff et al. | 350/290 |

*Primary Examiner*—Alfred E. Smith
*Assistant Examiner*—B. C. Anderson
*Attorney, Agent, or Firm*—Homer O. Blair; Robert L. Nathans; Gerald H. Glanzman

[57] ABSTRACT

A mirror structure designed to minimize damage to the mirror caused by soft X-rays. A reflective coating having a high reflectivity at wavelengths of interest is deposited on a glass substrate. The reflective coating has a moderately low atomic number to reduce direct susceptibility to substantial X-ray damage, and further has a high coefficient of thermal conductivity so that it is a good conductor of heat from the reflective coating to the glass substrate. Unfortunately, glass is a poor conductor of heat, and the accumulation of absorbed energy in the reflective coating will rapidly lead to crazing, melting, and vaporization. Accordingly the mirror structure is designed with a heat sink coating between the reflective coating and the glass substrate. The heat sink coating has a higher coefficient of thermal conductivity than glass so that it conducts heat away from the reflective coating, and also has an atomic number which is lower than glass so that it is subject to less X-ray energy absorption. In one disclosed embodiment, the reflective coating is aluminum and the hat sink coating is beryllium.

8 Claims, 1 Drawing Figure

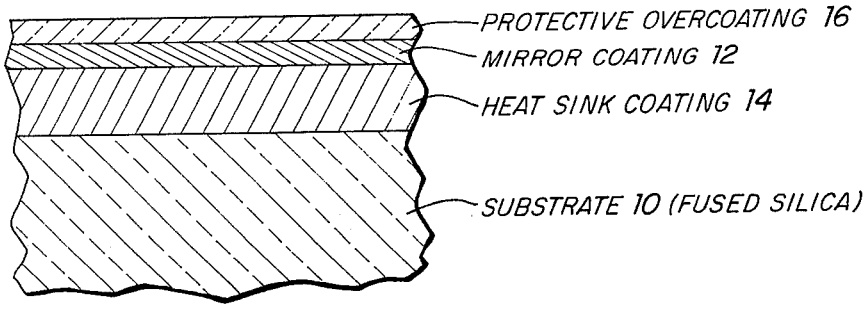
PROTECTIVE OVERCOATING 16
MIRROR COATING 12
HEAT SINK COATING 14
SUBSTRATE 10 (FUSED SILICA)

RADIATION DAMAGE RESISTANT MIRROR

BACKGROUND OF THE INVENTION

The present invention relates generally to the field of mirror structures, and more particularly pertains to a new and improved mirror structure which is designed to minimize mirror damage caused by an intense bombardment of soft X-rays.

In the field of optical surveillance systems, it is possible that attempts may be made to destroy particular optical systems by subjecting them to very high dosages of soft X-rays. With that possibility in mind, the present invention was designed to minimize susceptibility to damage by soft X-rays. Soft X-rays are generally not a problem in the design of most optical systems because they are not a very penetrating ray, and the first few microns of most materials, including the atmosphere, will absorb them. However, in some space applications, where X-rays are not absorbed by the atmosphere, they must be considered in the design of the optical system.

SUMMARY OF THE INVENTION

In accordance with the preferred embodiment, a mirror structure is disclosed which is designed to reflect radiation at wavelengths of interest while minimizing damage to the mirror surface caused by X-rays. The mirror structure includes a glass substrate which is a relatively poor conductor of heat. The mirror structure further includes a reflective coating on the glass substrate which has a moderately low atomic number so that it is not directly susceptible to substantial X-ray damage and a high coefficient of thermal conductivity so that it is a good conductor of heat to the glass substrate. Further, the mirror includes a heat sink coating between the reflective coating and the glass substrate which has a high coefficient of thermal conductivity such that it is a good conductor of heat from the reflective coating, and also has a low atomic number such that it also is subject to less X-ray energy absorption damage.

DESCRIPTION OF A PREFERRED EMBODIMENT

Referring to the FIGURE, there is illustrated a cross section of the mirror structure which is the subject of the present invention. The substrate material of the mirror 10 was chosen to be fused silica, or glass, as the state of the art of grinding and polishing glass materials is sufficiently advanced that the curvature and tolerances of the particular mirror of interest would be easily achievable within the present state of the art.

The substrate is coated with a mirror coating 12. A primary requirement of the mirror coating is that it be highly reflective at particular wavelengths of interest. Also, because of the unique environment in which the mirror structure will function, the reflective coating should have a moderately low atomic number such that most soft X-rays will pass through the coating without damaging or overheating it. Also, the coating should be a good conductor of heat so that any heat which is generated by soft X-ray absorption within it may be readily carried away. Such a reflective coating has several good candidates. It could be aluminum, having an atomic number of 13, silver having an atomic number of 47, or gold having an atomic number of 79. Aluminum is the preferred candidate. However, one disadvantage of aluminum is that it has a low melting point. A problem with putting the reflective coating directly on a glass substrate is that glass has a relatively low coefficient of thermal conductivity, and accordingly would conduct heat away from the reflective coating very slowly. This problem is overcome by placing another coating 14 intermediate to the glass substrate and the reflective coating. The intermediate coating may be considered to be a heat sink coating which has a high coefficient of thermal conductivity (compared to glass) so that it will conduct heat away from the reflective coating and a lower atomic number than glass so that it is subject to less X-ray energy absorption damage. The heat sink coating should also have a high melting point. Good candidates for the heat sink coating are beryllium, which has an atomic number of 4, and boron which has an atomic number of 5.

In one designed embodiment of this invention, the substrate was fused silica, the heat sink layer was beryllium which might be deposited on the substrate with a thickness as small as one-quarter micron, and the reflective coating was aluminum which may have a thickness of as little as 0.07 microns. The aluminum coating should be slightly thicker than the thickness required to reflect radiation at the wavelength of interest because some of the aluminum may diffuse into the beryllium layer.

In another embodiment of the invention, a protective overcoating 16 may be deposited on the reflective coating as shown. The reflective overcoating serves to protect the soft metal mirror coating from physical damage such as scratches, and may also provide some additional protection from soft X-rays.

In some applications where the reflectivity of the mirror coating does not have to be extremely high it may be possible to construct a mirror using just one coating of beryllium which would function as both the mirror coating and the heat sink coating. At some wavelengths beryllium has a reflectivity of approximately 90%, and it is a sufficiently good conductor of heat to function as a heat sink coating.

While several embodiments have been described, the teachings of this invention will suggest many other embodiments to those skilled in the art.

We claim:

1. A mirror structure designed to reflect radiation at wavelengths of interest while minimizing damage to the mirror surface caused by x-rays and comprising:

a. a glass substrate for the mirror, said glass substrate being substantially shaped to the desired configuration of the mirror, said glass substrate also having a relatively low coefficient of thermal conductivity such that it is a relatively poor conductor of heat;

b. a reflective coating on said glass substrate, said reflective coating having a high reflectivity at said wavelengths of interest, having a low atomic number so it is not susceptible to substantial x-ray damage, and having a relatively high coefficient of thermal conductivity compared to said glass substrate such that it is a good conductor of heat to said glass substrate; and c. a heat sink coating between said reflective coating and said glass substrate, said heat sink coating having a relatively high coefficient of thermal conductivity compared to said glass substrate such that it is a good conductor of heat away from said reflective coating, and having a low atomic number such that it is not subject to substantial x-ray damage.

2. A mirror structure as set forth in claim 1 wherein said glass substrate is fused silica.

3. A mirror structure as set forth in claim 2 wherein said reflective coating includes a coating of aluminum having a thickness of at least 0.07 microns.

4. A mirror structure as set forth in claim 3 wherein said heat sink coating includes a coating of beryllium having a thickness of at least 0.25 microns.

5. A mirror structure as set forth in claim 4 and further including a protective overcoating coated on top of said mirror coating for physically protecting said mirror coating against possible physical damage.

6. A mirror structure as set forth in claim 1 wherein said reflective coating includes a coating of aluminum having a thickness of at least 0.07 microns.

7. A mirror structure as set forth in claim 1 wherein said heat sink coating includes a coating of beryllium having a thickness of at least 0.25 microns.

8. A mirror structure as set forth in claim 1 and further including a protective overcoating coated on top of said mirror coating for physically protecting said mirror coating against possible physical damage.

* * * * *